US007781692B2

(12) United States Patent
Heerlein et al.

(10) Patent No.: US 7,781,692 B2
(45) Date of Patent: Aug. 24, 2010

(54) SWITCH

(75) Inventors: Markus Heerlein, Singapore (SG); Wee Haw Koo, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 224 days.

(21) Appl. No.: 11/989,340

(22) PCT Filed: Jul. 30, 2005

(86) PCT No.: PCT/SG2005/000257

§ 371 (c)(1),
(2), (4) Date: Jan. 24, 2008

(87) PCT Pub. No.: WO2007/015678

PCT Pub. Date: Feb. 8, 2007

(65) Prior Publication Data

US 2009/0133998 A1 May 28, 2009

(51) Int. Cl.
*H01H 3/00* (2006.01)

(52) U.S. Cl. ..... 200/557; 200/339; 200/18

(58) Field of Classification Search ..... 200/11 R, 200/339, 6 A, 14, 18

See application file for complete search history.

(56) References Cited

U.S. PATENT DOCUMENTS

| | | | | |
|---|---|---|---|---|
| 4,382,166 | A * | 5/1983 | Kim | 200/6 A |
| 4,384,847 | A | 5/1983 | Schirneker | |
| 5,691,517 | A | 11/1997 | Yamamoto et al. | |
| 6,211,474 | B1 * | 4/2001 | Takahashi | 200/18 |
| 6,388,212 | B1 * | 5/2002 | Ishihara et al. | 200/18 |
| 6,396,016 | B1 * | 5/2002 | Lin et al. | 200/564 |
| 6,646,211 | B2 * | 11/2003 | Taniuchi et al. | 200/4 |
| 6,984,794 | B2 * | 1/2006 | Kawamura | 200/14 |
| 7,054,408 | B2 | 5/2006 | Jiang et al. | |
| 2005/0067263 | A1 | 3/2005 | Kawamura et al. | |
| 2005/0150749 | A1 | 7/2005 | Lung | |
| 2006/0018496 | A1 * | 1/2006 | Niederdrank et al. | 381/312 |

FOREIGN PATENT DOCUMENTS

| | | |
|---|---|---|
| EP | 0 724 278 A2 | 7/1996 |
| WO | 03043040 A2 | 5/2003 |

* cited by examiner

*Primary Examiner*—Renee S Luebke
*Assistant Examiner*—Lisa Klaus

(57) ABSTRACT

A switch for controlling first and second components of an electric circuit is proposed. The switch is operable between first and second positions to control the operation of the first of said components and is operable between third and fourth positions to control operation of the second of said components.

11 Claims, 5 Drawing Sheets

SWITCH

CROSS REFERENCE TO RELATED APPLICATIONS

This application is the US National Stage of International Application No. PCT/SG2005/000257 filed Jul. 30, 2005 and claims the benefits thereof, which is incorporated by reference herein in its entirety.

TECHNICAL FIELD OF THE INVENTION

The present invention relates to a switch.

BACKGROUND OF THE INVENTION

Hearing aid devices are designed to be worn either behind the ear or in the ear of a person. The devices are typically quite small so that they are comfortable to wear and so that they are not easily seen when fitted to an ear of a person. Consequently, internal space for the various electric components is generally at a premium.

Hearing aid devices have previously included separate volume control and program switches for respectively adjusting the audible output of the device and the program mode of the device. These switches occupy separate areas of the electric circuit board of the hearing aid device. The inclusion of separate switches to effect these operations, for example, may be expensive and may not be an efficient use of the available internal space of the hearing aid device.

The volume control switch and the program switch, for example, have previously been separately manually soldered to the circuit board of the hearing aid device. It may be time consuming and inefficient to separately solder the volume control switch and the program switch to the circuit board of the hearing aid device.

It is generally desirable to overcome or ameliorate one or more of the above mentioned difficulties, or at least provide a useful alternative.

SUMMARY OF THE INVENTION

In accordance with one aspect of the present invention, there is provided a switch for controlling first and second components of an electric circuit, said switch being operable between first and second positions to control the operation of the first of said components and being operable between third and fourth positions to control operation of the second of said components.

Preferably, the switch includes a dial being adapted to rotate about an axis between said first and second positions and being adapted to move radially with respect to said axis between said third and fourth positions.

Preferably, the switch is adapted to send a first control signal to the first component when arranged in the first position, and to send a second control signal to the first component when arranged in the second position.

Preferably, the switch is adapted to send a third control signal to the second component when arranged in the third position, and to send a fourth control signal to the second component when arranged in the fourth position.

Advantageously, the switch combines a digital volume control with a tact switch

Advantageously, the switch saves space on electric circuits by combining two or more switches into one unit.

Advantageously, the switch reduces construction time and cost of hearing aid devices, for example. The construction of the switch allows for the use of surface mount technology reflow and therefore allows the automation of the assembly process.

In accordance with another aspect of the invention, there is provided, in combination, a switch and a tact switch, said switch being operable between first and second positions to control the operation of a first electronic component and being operable between third and fourth positions to control operation of the tact switch.

Preferably, the switch includes a dial being adapted to rotate about an axis between said first and second positions and being adapted to move radially with respect to said axis between said third and fourth positions.

Preferably, the dial is adapted to move radially with respect to an axis defined by the axle into and out of the housing between said third and fourth positions.

Preferably, the switch is adapted to engage a contact of the tact switch when arranged in the third position to thereby control the tact switch.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
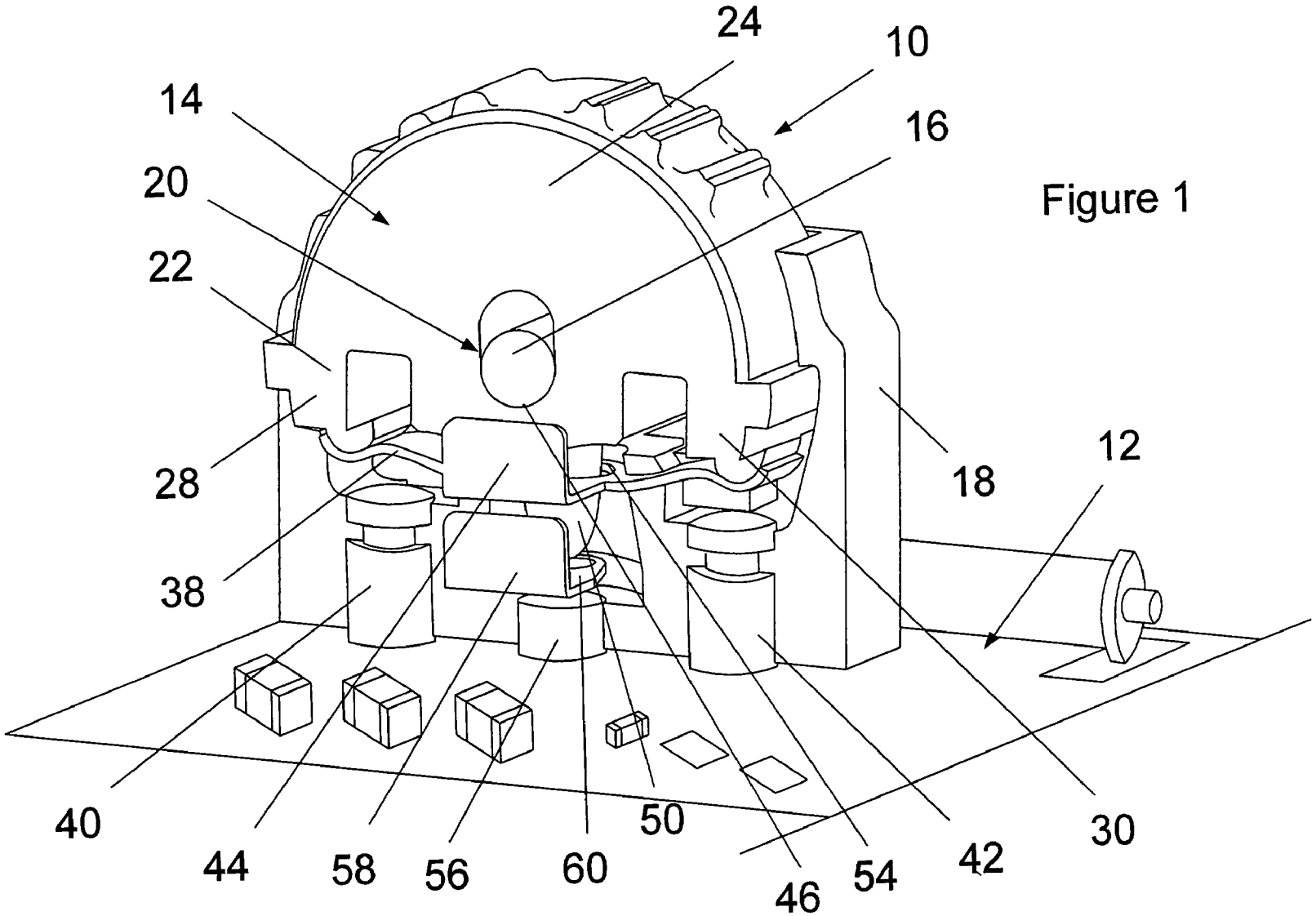
FIG. 1 is a perspective view of a switch coupled to an electric circuit with part of the housing removed so as to show the internal parts of the switch.
Figure 2:
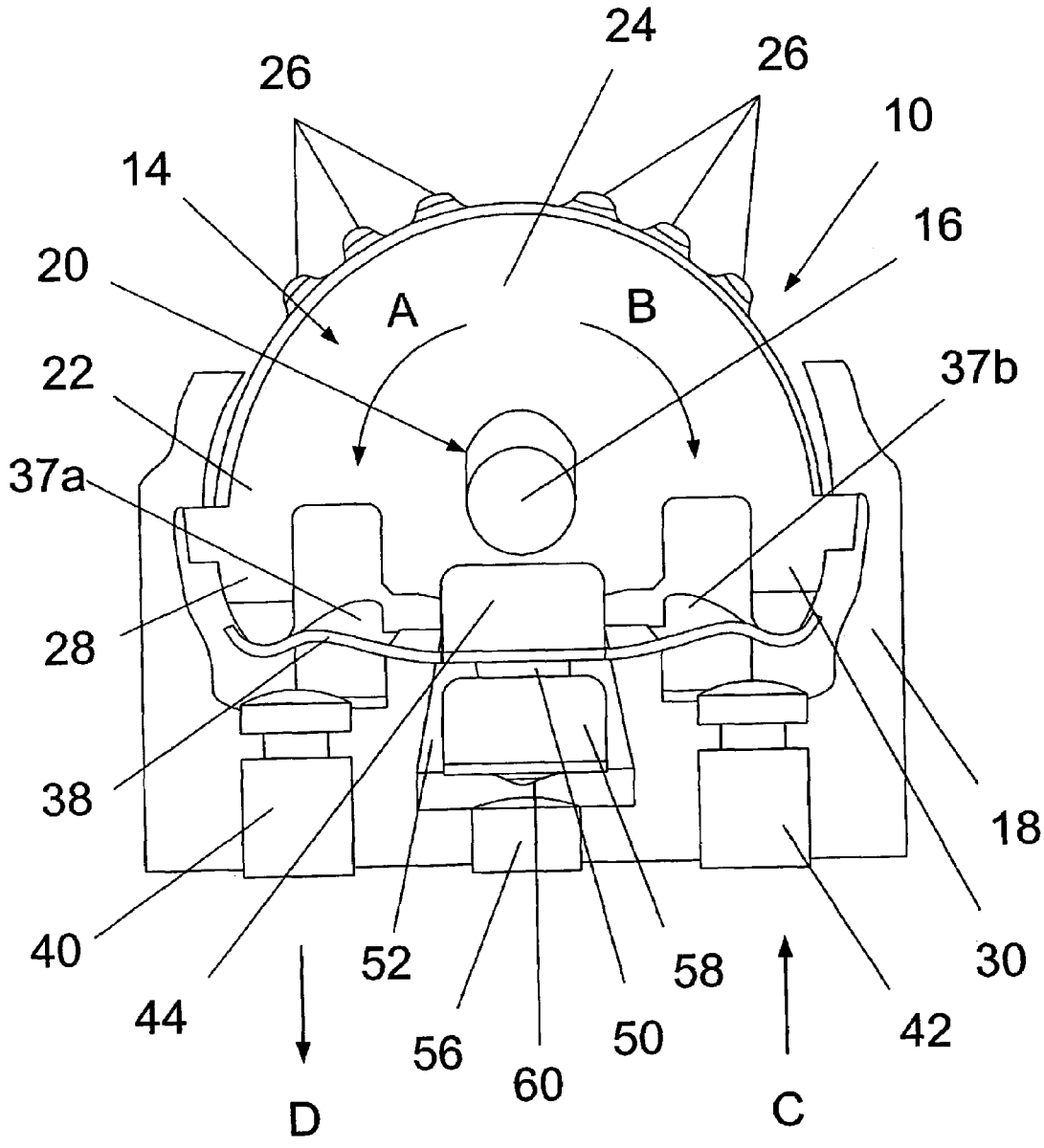
FIG. 2 is a front view of the switch shown in FIG. 1 with part of the housing removed so as to show the internal parts of the switch.
Figure 3:
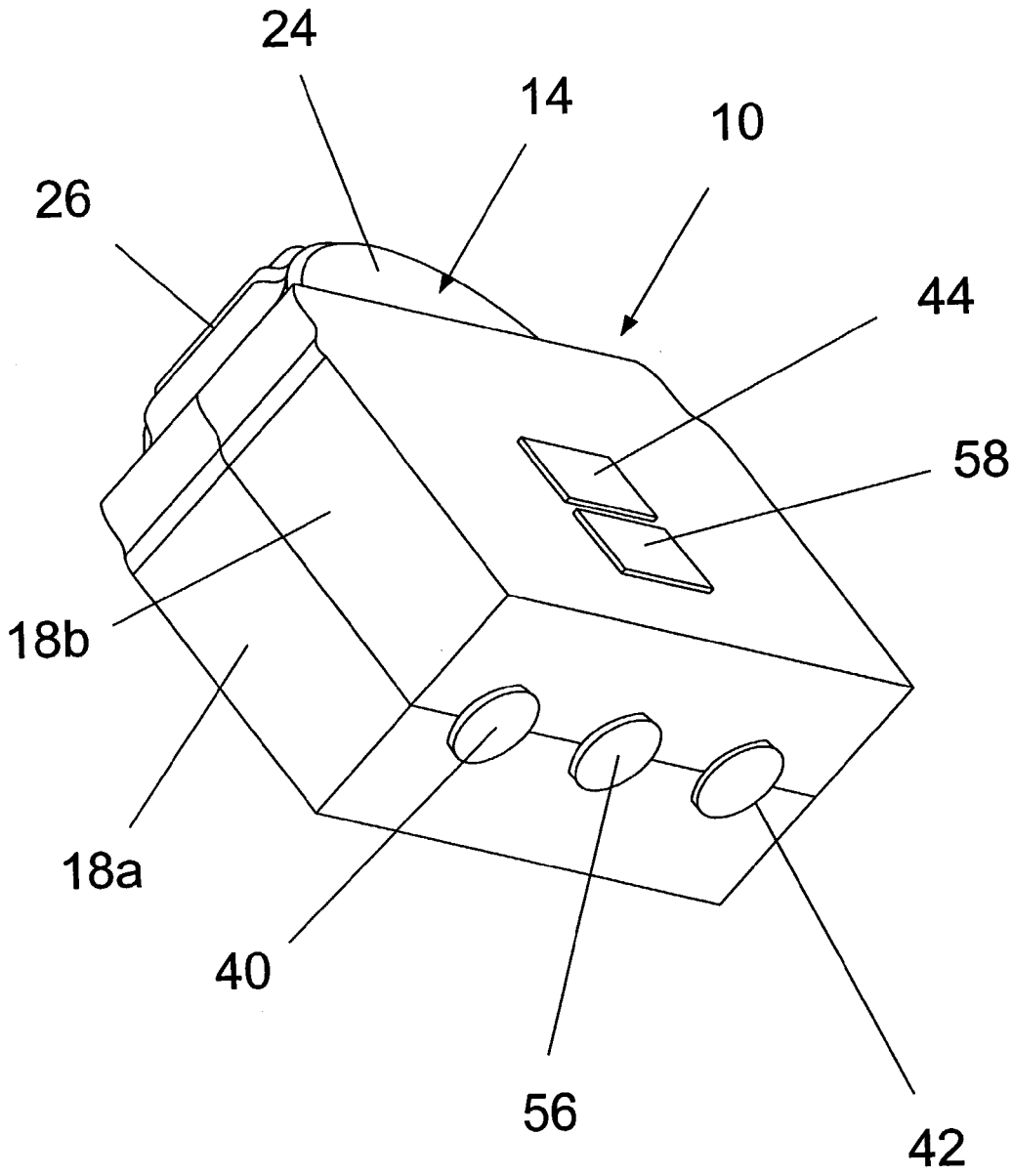
FIG. 3 is a perspective view of the switch shown in FIG. 1.

The switch 10 shown in FIGS. 1 to 3 is used to control the operation of first and second components (not shown) of the electric circuit 12. The switch 10 may be advantageously coupled to electric circuit 12 through, for example, surface mount technology. The switch 10 includes a semicircular dial 14 that is operable to rotate about an axis defined by an axle 16 between first and second positions. The switch 10 sends a first signal to first component when arranged in the first position and a second signal to the first component when arranged in the second position. The switch 10 thereby controls the operation of the first component.

The dial 14 is also operable to move radially up and down with respect to said axle 16 between third and fourth positions. The switch 10 sends a third signal to the second component when arranged in the third position and a fourth signal to the second component when arranged in the fourth position. The switch 10 thereby controls the operation of the second component.

The switch 10 is hereafter described by way of reference to a hearing aid device including a volume control unit and a program control unit. The switch 10 is operable to control these components. However, it would be understood by those skilled in the relevant art that the switch 10 is suitable for use in controlling the operation of any two components of an electric circuit.

The switch 10 includes:

1. A housing 18;

2. A dial 14; and

3. An axle 16.

The housing 18 comprises first and second shells 18*a*, 18*b* that, when coupled together, encase most of the parts of the switch 10. The internal walls of the housing 18 conform to the shape of the parts of the switch 10 and thereby assist in keeping the parts in place. The shells 18*a*, 18*b* of the housing 18 are held together by an adhesive, for example. The shells 18*a*, 18*b* of the housing 18 can otherwise be secured together by screws, or by any other suitable means. The housing 18 is preferably made of ACP, vector.

Figure 4:
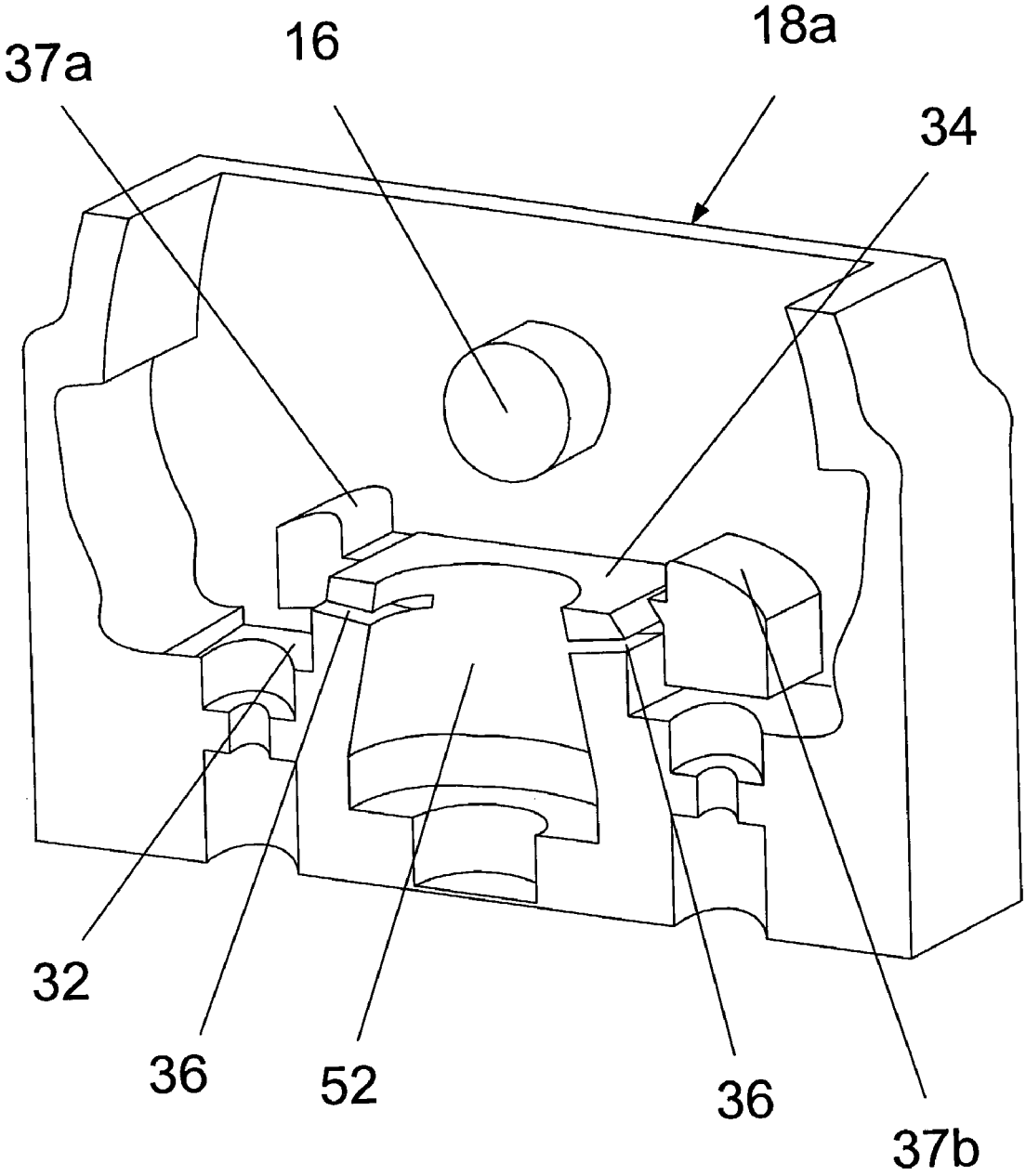
FIG. 4 is a perspective view of a part of the switch shown in FIG. 1.

The axle 16 is coupled to the first shell, as shown in FIG. 4, and extends towards the second shell 18*b*. The axle 16 is preferably formed integrally with the first shell 18*a*.

The dial 14 includes a centrally disposed aperture 20 that is shaped to receive the axle 16. When the dial 14 is located on the axle 16, the housing 18 wraps around an lower section 22 of the dial 14. An upper section 24 of the dial 14 protrudes from the housing 18 when the dial 14 is mounted on the axle 16. The upper section 24 of the dial 14 includes a plurality of raised bumps 26 to assist in rotating the dial 14 about the axle 16 between the above-described first and second positions. The dial 14 is preferably made of polyamide or nylon, PA 6.6.

The lower, internal, section 22 of the dial 14 includes first and second protrusions 28,30 that extend downwardly into the housing 18 from opposite ends of the dial 14. As the dial 14 rotates anticlockwise towards the first position, the first protrusion 28 rotates about the axle 16, in direction "A", further into the housing 18. Conversely, as the dial 14 rotates clockwise towards the second position, the second protrusion 30 rotates about the axle 16, in direction "B", further into the housing 18.

An internal bottom surface 32 of the housing 18 includes a raised platform 34 having lateral slits 36 cut there through. The lateral slits 36 are shaped to support an electrically conductive spring 38 arranged to extend laterally there through. When so located, the spring 38 extends laterally between, and resiliently bears against, tip ends of the first and second protrusions 28,30 of the dial 14. The spring 38 acts to force the dial 14 in direction "C". Further, the spring 38 resiliently bears against the first protrusion 28 when the dial 14 is rotated towards the first position and acts to restore the dial 14 to the neutral position shown in FIG. 2. Conversely, the spring 38 resiliently bears against the second protrusion 30 when the dial 14 is rotated towards the second position and acts to restore the dial to the neutral position. Consequently, the spring 38 resiliently inhibits rotation of the dial 14 between first and second positions and acts to retain the dial in a neutral position between the first and second positions.

The housing 18 includes stoppers 37*a*,37*b* located on opposite sides of the raised platform 34 that limit the extent of rotation of the dial 14 between the first and second positions.

The switch 10 may be connected to ground via contact 40 and a voltage supply via contact 42, which is respectively coupled to the voltage source (not shown) and the ground (not shown) of the electric circuit 12. Interchanging the connections, so that contact 40 is connected to the voltage supply and contact 42 is connected to the ground may also be done. The contacts 40,42 extend upwardly through the internal bottom surface 32 of the housing 18 towards the first and second protrusions 28,30. The spring 38 suspends the tip ends of the protrusions 28,30 over respective contacts 40,42 in the described neutral position. In this position, the spring is electrically isolated from the contacts 40,42. However, the electrically conductive spring 38 engages the ground contact 40 when the dial 14 is arranged in the first position. Similarly, the spring 38 engages the voltage supply contact 42 when the dial 14 is arranged in the second position. The contacts 40,42 are preferably stainless steel (1.4305).

In one illustration, for example, the ground contact 40 receives a 0 Volt signal from the electric circuit 12 and the voltage supply contact 42 receives a 1.3 Volt signal from the electric circuit 12. The switch 10 may also be used with different voltage levels, depending on the circuitries of the electric circuit 12.

The spring 38 includes a volume control contact 44 located centrally between the first and second protrusions 28,30. The volume control contact 44 extends through the second shell 18*b* of the housing 18 for electrical connection to the electric circuit 12. The switch 10 communicates with the volume control unit of the electric circuit by way of the volume control contact 44. The switch 10 can thereby be configured to send either a 0 Volt signal or a 1.3 Volt signal to the volume control unit. A 0 Volt signal may represent a request for the volume control unit to increase the audible output of the hearing aid device. Conversely, a 1.3 Volt signal may represent a request to decrease the audible output of the hearing aid device. The volume control contact 44 is preferably stainless steel (1.4310).

The aperture 20 of the dial 14 is elliptic in shape and allows for translation of the dial 14 in the directions "C" and "D". As above described, the spring 38 resiliently bears against the protrusions 28,30 and upwardly pushes the dial 14 in direction "C". The axle 16 is thereby resiliently held in engagement with a lower section 46 of the elliptic aperture 20. The dial is located in the third position when arranged in this manner. The dial 14 can move downwardly into the housing 18 by pushing the dial 14 in directions in "D". An upper section 48 of the elliptic aperture 20 limits translation of the dial 14 with respect to the axle 16 in direction "D". The dial 14 is located in the fourth position when arranged in this manner. The spring 38 acts to restore the dial 14 to the third position when the force applied in directions "D" is removed. The dial 14 thereby resiliently moves between the above-mentioned third and fourth positions.

The lower section 22 of the dial 14 includes a third protrusion 50, located between the first and second protrusions 28,30, that extends downwardly into the housing 18. The third protrusion 50 extends further towards the internal bottom surface 32 of the housing than either one of the first and second protrusions 28,30 into a well 52 defined by the raised platform 34. The well 52 is a hollow cone that is shaped to accommodate translation of the third protrusion 50 in the third and fourth directions, as well as translation of the third protrusion 50 as a result of the dial rotating between the first and second positions. The third protrusion 50 extends towards the well 52 through an aperture 54 in the electrically conductive spring 38.

The switch 10 includes another contact 56 which may be coupled to the voltage source of the electric circuit 12. The voltage source is typically set at 1.3 Volt although different voltage levels may also be used, depending on the circuitries of electric circuit 12. The contact 56 extends upwardly through the internal bottom surface 32 of the housing 18 towards third protrusions 50. The spring 38 suspends a tip end of the third protrusion 50 over the contact 56.

The switch 10 also includes an electrically conductive push button contact 58 that extends through the second shell 18*b* of the housing 18 for electrical connection to the electric circuit 12. The switch 10 communicates with the program control unit (not shown) by way of the push button contact 58. The push button contact 58 includes a flange 60 located between a tip end of the third protrusion 50 and the contact 56. As the dial 14 is resiliently pushed into the housing 18 when a force is applied in direction "D", the third protrusion 50 engages a flange 60 and pushes it to engage contact 56. The push button contact 58 is thereby held in electrical communication with the contact 56. The dial is arranged in the fourth position when arranged in this manner. The push button contact 58 is again held in electrical isolation when the dial 14 retracts upwardly under the bias of the spring 38 when the force in direction "D" is released. The push button contact 58 is preferably stainless steel (1.4310).

The switch 10 may thereby be used to send a 1.3 Volt signal to the program control unit. The 1.3 Volt signal may represent a request to toggle between the various operational modes of the hearing aid device.

Alternatively, the contact 56 may be coupled to the ground of the electric circuit 12. The switch 10 can thereby be used to send a 0 Volt signal to the program control unit. The 0 Volt signal may represent a request to toggle between the various modes operational modes of the hearing aid device.

Figure 5:
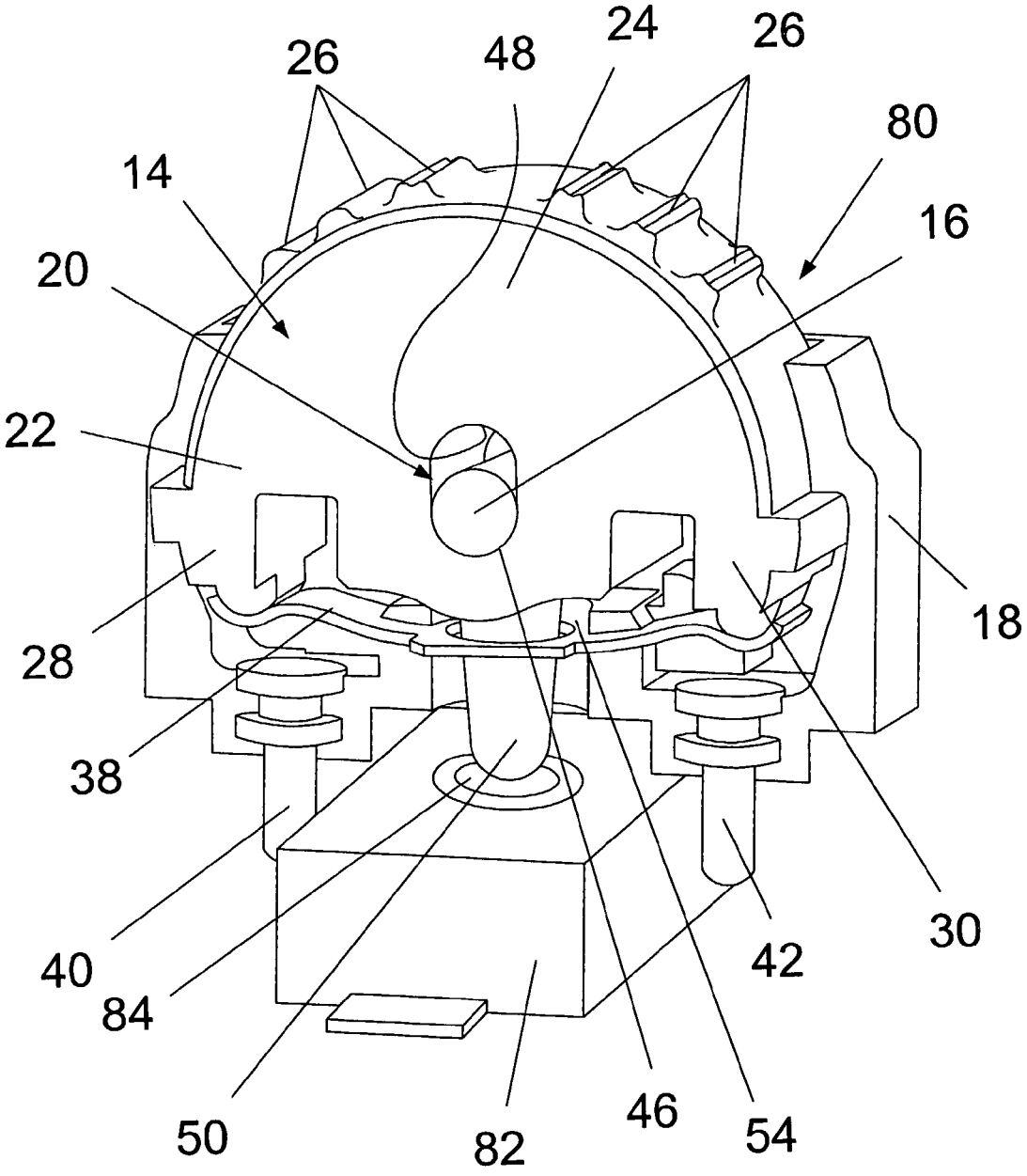
FIG. 5 is a perspective view of an alternative embodiment of a switch coupled to a tact switch.

The switch 80 shown in FIG. 5 functions in an analogous manner to the above described switch 10. In this alternative embodiment of the invention, switch 10 may modified to be used in conjunction with a tact switch 82 whereby the third protrusion 50 is coupled to an external tact switch 82. Translation of the dial 14 in direction "D" forces a tip end of the third protrusion 50 to engage a contact 84 of the tact switch 82. The switch 80 can thereby be used to control the operation of the tact switch 82.

The switch 10,80 advantageously saves space on the electric circuit 12, which is important considering the small size of a hearing aid. The switch 10,80 advantageously increases efficiency and reduces the cost of manufacturing the hearing aids. The construction of the combined switch allows for the use of surface mount technology reflow (machine operated).

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

Claims defining the invention are as follows:

1. A switch for controlling a first and a second component of an electric circuit, comprising:

a dial that rotates about an axle between a first and a second position and moves radially with respect to the axle between a third and a fourth position; and an electrically conductive spring electrically contacted to the electric circuit that resiliently inhibits rotation of the dial towards the first and the second position and locates the dial in a neutral position between the first and the second position, wherein the switch is configured to be operated between the first and the second position to control the first component and to be operated between the third and the fourth position to control the second component.

2. The switch as claimed in claim 1, wherein the switch sends a first control signal to the first component when arranged in the first position and sends a second control signal to the first component when arranged in the second position.

3. The switch as claimed in claim 1, wherein the switch sends a third control signal to the second component when arranged in the third position and sends a fourth control signal to the second component when arranged in the fourth position.

4. The switch as claimed in claim 1, further comprising a housing.

5. The switch as claimed in claim 4, wherein the axle extends between a first and a second side of the housing and the dial rotates about the axle between a first and a second position.

6. The switch as claimed in claim 4, wherein the axle extends into and out of the housing between the third and the fourth position and the dial moves radially with respect to the axis.

7. The switch as claimed in claim 1, wherein the switch resiliently holds the dial in the third position.

8. The switch as claimed in claim 1, wherein the first component is a volume control unit of a hearing aid device and the second component is a program control unit of the hearing aid device.

9. The switch as claimed in claim 1, wherein the electrically conductive spring provides an electrical contract to the electric circuit to control the first component.

10. A switch for controlling an electronic component of an electric circuit and a tact switch, comprising:

a dial that rotates about an axle between a first and a second position and moves radially with respect to the axle between a third and a fourth position; and an electrically conductive spring electrically contacted to the electric circuit that resiliently inhibits rotation of the dial towards the first and the second position and locates the dial in a neutral position between the first and the second position, wherein the switch is configured to be operated between the first and the second position to control the electronic component and to be operated between the third and the fourth position to control the tact switch.

11. The switch as claimed in claim 10, wherein the electrically conductive spring provides an electrical contract to the electric circuit to control the electronic component.

* * * * *